US006464079B1

(12) United States Patent
Newman

(10) Patent No.: US 6,464,079 B1
(45) Date of Patent: Oct. 15, 2002

(54) SUSPENSION AIR PACKAGING DEVICE

(75) Inventor: Garry F. Newman, Castaic, CA (US)

(73) Assignee: Air Packaging Technologies, Inc., Valencia, CA (US)

( * ) Notice: Subject to any disclaimer, the term of this patent is extended or adjusted under 35 U.S.C. 154(b) by 0 days.

(21) Appl. No.: 09/731,089

(22) Filed: Dec. 6, 2000

Related U.S. Application Data

(60) Provisional application No. 60/169,479, filed on Dec. 7, 1999.

(51) Int. Cl.[7] ..... B65D 81/02

(52) U.S. Cl. ..... 206/522; 206/590

(58) Field of Search ..... 206/522, 583, 206/814, 521, 591, 592, 590; 383/3

(56) References Cited

U.S. PATENT DOCUMENTS 3,554,135 A * 1/1971 Davall ..... 206/522
4,874,093 A * 10/1989 Pharo ..... 206/522
5,348,157 A * 9/1994 Pozzo ..... 206/522
5,480,029 A * 1/1996 Batsford ..... 206/522
5,487,470 A * 1/1996 Pharo ..... 206/522
5,570,788 A * 11/1996 Batsford ..... 206/522
5,588,533 A * 12/1996 Farison et al. ..... 206/522
5,762,197 A * 6/1998 Farison ..... 206/522
5,803,263 A * 9/1998 Pozzo ..... 206/522
5,862,914 A * 1/1999 Farison et al. ..... 206/522

* cited by examiner

*Primary Examiner*—Shian Luong
(74) *Attorney, Agent, or Firm*—John R. Thompson; Stoel Rives LLP

(57) ABSTRACT

An inflatable air packaging device includes a tubular, inflatable member surrounding an object receiving pocket. The pocket is configured in a shape and size to receive, retain, and suspend an object. The inner and outer surfaces of the member are secured to one another to form a plurality of apertures. Each aperture is configured to receive a portion of the object to suspend the object within the pocket. In one embodiment, there are four apertures which each receive a corner of a rectangular object. The device provides a circular air cushion chamber which is disposed around a perimeter of the object. Forces applied to the device are uniformly distributed around the device to minimize the effect on the object.

18 Claims, 7 Drawing Sheets

SUSPENSION AIR PACKAGING DEVICE

RELATED APPLICATIONS

This application claims priority to U.S. patent application Ser. No. 60/169,479, filed on Dec. 7, 1999.

BACKGROUND OF THE INVENTION

1. Field of the Invention

The present invention is related to air packaging devices and more specifically to air packaging devices to support and retain an object therein.

2. Relevant Technology

Conventional packaging devices incorporate a variety of materials to protect and insulate a packaged item. One of these conventional packaging materials is known as "bubble-pack." Bubble-pack consists of two layers of thin plastic material, such as polyethylene or vinyl formed with random bubbles between the layers and filled with air at time of manufacture. Bubble-pack requires large rolls of bubble material that displace a great deal of volume in storage before use.

Bubble-pack is bulky, and therefore expensive to ship and to store during the period before it is put to use. Furthermore, conventional bubble-pack provides limited protection in certain applications because of the fixed bubble diameter, height, and count in a given material area.

Another conventional packaging material is pre-shaped styrofoam objects. An example of this is styrofoam "peanuts," which are distributed in mass around a packaged article. Another example is pre-formed styrofoam blocks which are fitted to restrain a packaged item. Styrofoam blocks prevent the packaged item from moving in directions during travel. Styrofoam material experiences some of the same disadvantages of the bubble-pack. Styrofoam material is bulky and expensive to ship and store. Furthermore styrofoam provides limited protection in certain applications because of the fixed dimensions and shape of the styrofoam.

Inflatable packaging devices have overcome some of the limitations of previous packaging materials. Inflatable packaging devices may be shipped and stored in a deflated condition, thereby reducing the expense of shipment and storage. Furthermore, inflatable packaging devices provide cushions of filler material, such as air, which is under pressure. The filler material functions to absorb and redistribute forces acting on the packages, thereby protecting a delicate item of merchandise encapsulated and suspended therein. Articles encapsulated by the inflatable packaging device are prevented from substantially moving in directions relative to the packaging.

The following list of patents disclose several improvements of inflatable packaging devices and are hereby incorporated by reference:

- U.S. Pat. No. 4,597,244, issued Jul. 1, 1986 for "Method For Forming An Inflated Wrapping;"
- U.S. Pat. No. 4,793,123, issued Dec. 27, 1988 for "Rolled-up Packaging System and Method;"
- U.S. Pat. No. 4,872,558, issued Oct. 10, 1989, for "Bag-In-Bag Packaging System;"
- U.S. Pat. No. 4,918,904, issued Apr. 24, 1994, for "Clam-Like Packaging System;"
- U.S. Pat. No. 4,949,530, issued Oct. 21, 1994, for "Method for Forming Bag-In-Bag Packaging System;"
- U.S. Pat. No. 5,272,856, issued Dec. 28, 1993, for "Packaging Device That is Flexible, Inflatable, and Reusable and Shipping Method Using the Device;"

- U.S. Pat. No. 5,427,830 issued Jun. 27, 1995, for "Continuous, Inflatable Plastic Wrapping Material;"
- U.S. Pat. No. 5,445,274, issued Aug. 29, 1995, for "Inflatable Package Insert;"
- U.S. Pat. No. 5,447,235 issued Sep. 5, 1995, for "Bag With Squeeze Valve and Method For Packaging an Article Therein;"
- U.S. Pat. No. 5,487,470 issued Jan. 30, 1996, for "Merchandise Encapsulating Packaging System and Method Therefor;"
- U.S. Pat. No. 5,588,532 issued Dec. 31, 1996, for "Self-Sealing Inflatable Bag and Method For Packaging an Article Therein;" and
- U.S. Pat. No. 5,711,691 issued Jan. 27, 1998 for "Self-Closing and Self-Sealing Valve Device For Use With Inflatable Structures."

Some of the above patents disclose air packaging devices involving distinct, separate pouches or bags that are manufactured from two or more plies. For example, several of the inventions disclose a four-ply bag, which are used to form outer and inner chambers. The outer chamber is inflated with a filler material, such as air and is separated from the inner chamber. The inner chamber retains the packaged item, thereby providing a total air cushion around the product.

A disadvantage of some of these air packaging devices is that they fail to properly suspend, insulate, and protect an item. Commonly, this is because the devices fail to protect an item from g-forces in one particular direction as they do not evenly distribute such force. Thus, items which are particularly sensitive to force in one plane are at risk. Furthermore, the shapes that some packaging devices take when inflated may not be convenient for packaging in containers having cubical dimensions.

It would, therefore, be an advancement in the art to provide a packaging device which better insulates an item and evenly distributes g-forces to which an item may be subject. Forces in a particular plane would therefore be minimized. It would further be an advancement in the art to provide a packaging device with advantages of the air packaging devices which could be used within cubicle containers. Such an invention is disclosed and claimed herein.

BRIEF DESCRIPTION OF THE DRAWINGS

In order that the manner in which the advantages and features of the invention are obtained, a more particular description of the invention summarized above will be rendered by reference to the appended drawings. Understanding that these drawings only provide selected embodiments of the invention and are not therefore to be considered limiting of the scope, the invention will be described and explained with additional specificity and detail through the use of the accompanying drawings in which.

DETAILED DESCRIPTION OF THE PREFERRED EMBODIMENTS

A preferred embodiment of the invention is now described with reference to the FIGS. 1–8, where like reference numbers indicate identical or functionally similar elements. The components of the present invention, as generally described and illustrated in the Figures, may be implemented in a wide variety of configurations. Thus, the following more detailed description of the embodiments of the system and method of the present invention, as represented in the Figures, is not intended to limit the scope of the invention, as claimed, but is merely representative of presently preferred embodiments of the invention.

Figure 1:
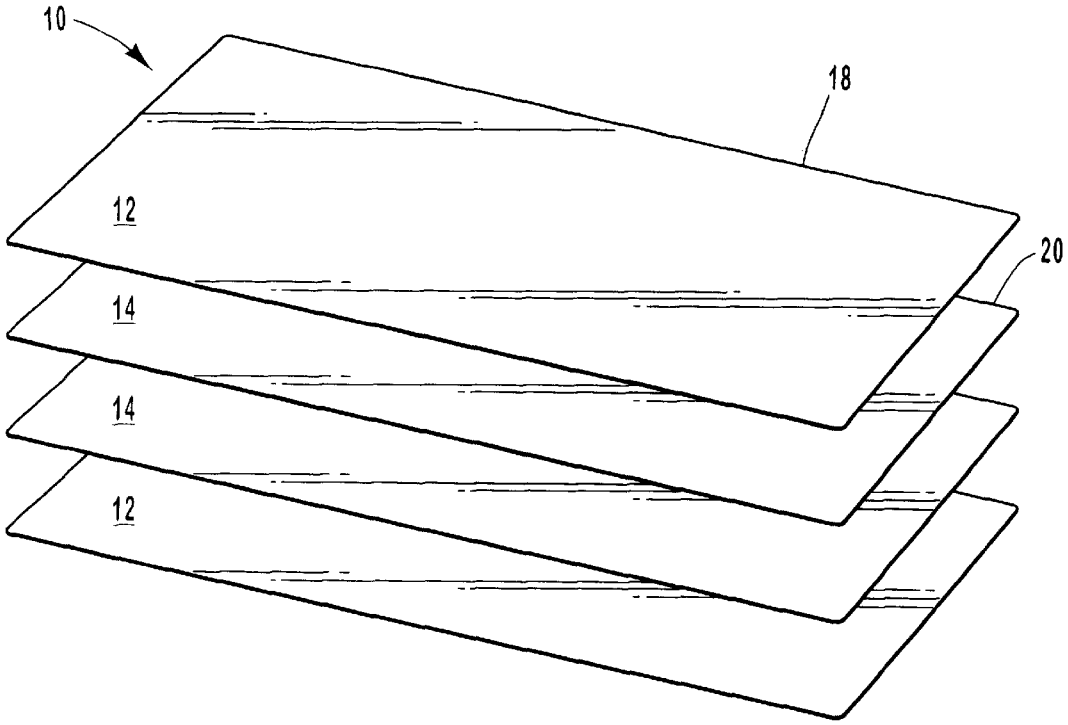
FIG. 1 is a perspective view of components of the air packaging device of the present invention.

Referring to FIG. 1 there are shown overlying panels 10 which may be incorporated into an embodiment of the present invention. The panels 10 include a pair of outer panels 12 and inner panels 14 which may be configured in various shapes including a general rectangular shape. The panels 10 may be configured into shapes that are substantially similar to one another. The inner panels 14 are disposed between the outer panels 12 and the panels 10 are connected to one another such as by sealing or by using other conventional methods. Such sealing methods include heat sealing the panels 10 at select areas to form a packaging device of the present invention.

The panels 10 are preferably composed of a flexible, gas impervious composite laminate. Currently preferred composite laminates are adapted to melt in the range of 300 degrees F. The panels 10 of the device may be formed from a variety of polymers comprising various amounts of polyethylene, nylon, and metallocene. Such types of composite laminates are well known in the art.

Figure 2:
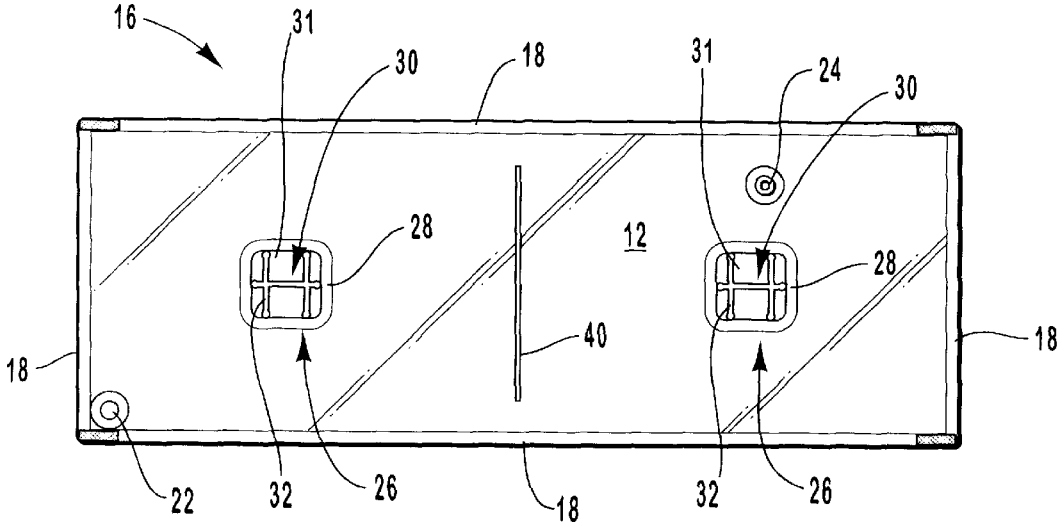
FIG. 2 is a plan view of one embodiment of the air packaging device of the present invention.

Referring to FIG. 2, and with continued reference to FIG. 1, a plan view of one embodiment of a deflated inflatable packaging device is shown. The device 16, comprises the four overlying panels 10 shown in FIG. 1. The outer panels 12 include peripheral edges 18 which are sealed to peripheral edges 20 of the inner panels 14 to thereby create first and second chambers (not shown). The peripheral edges 20 of the inner panels 14 are further sealed to one another.

The device 16 further comprises an air exchange passage 22 to provide communication between the first and second chambers of the packaging device 16. The air exchange passage 22 may be formed by forming adjacent apertures in the inner panels 14. The apertures are sealed together along their perimeters to create the air exchange passage 22. The passage 22 allows communication of a filler medium between the first and second chambers. In this manner, the first and second chambers create a main chamber and communication is maintained throughout the device 16.

The packaging device 16 further incorporates a flow channel 24 which is disposed on an outer panel 12 and in communication with the first or second chamber. The flow channel 24 may be any number of various devices for filling the chamber with a filler medium such as air. In one embodiment, the flow channel 24 may be a push-pull valve. The push-pull valve allows for inflation and deflation of the device 16 to permit reuse. The flow channel 24 may also be embodied as a flat valve such as that disclosed in U.S. Pat. No. 5,711,691. Ideally, the flow channel 24 is leak free and is strategically located on the packaging device 16 to allow easy inflation of the main chamber and to minimize contact between the flow channel 24 and an exterior container.

The device 16 may further comprise one or more corner apertures 26 that accommodate a comer or other protruding portion of an object to be shipped. A comer aperture 26 may be created by sealing the outer and inner panels 12, 14 together to define a perimeter 28 and an interior 30. The perimeter 28 is entirely sealed to prevent communication between the interior 30 and the main chamber. The interior 30 represents portions of the outer and inner panels 12, 14 that is not inflatable and is not part of the main chamber.

The material of the interior 30 may be removed or otherwise punched out to provide an egress for a portion of an object. Alternatively, the material of the interior 30 may not be removed or may be partially removed.

Figure 3:
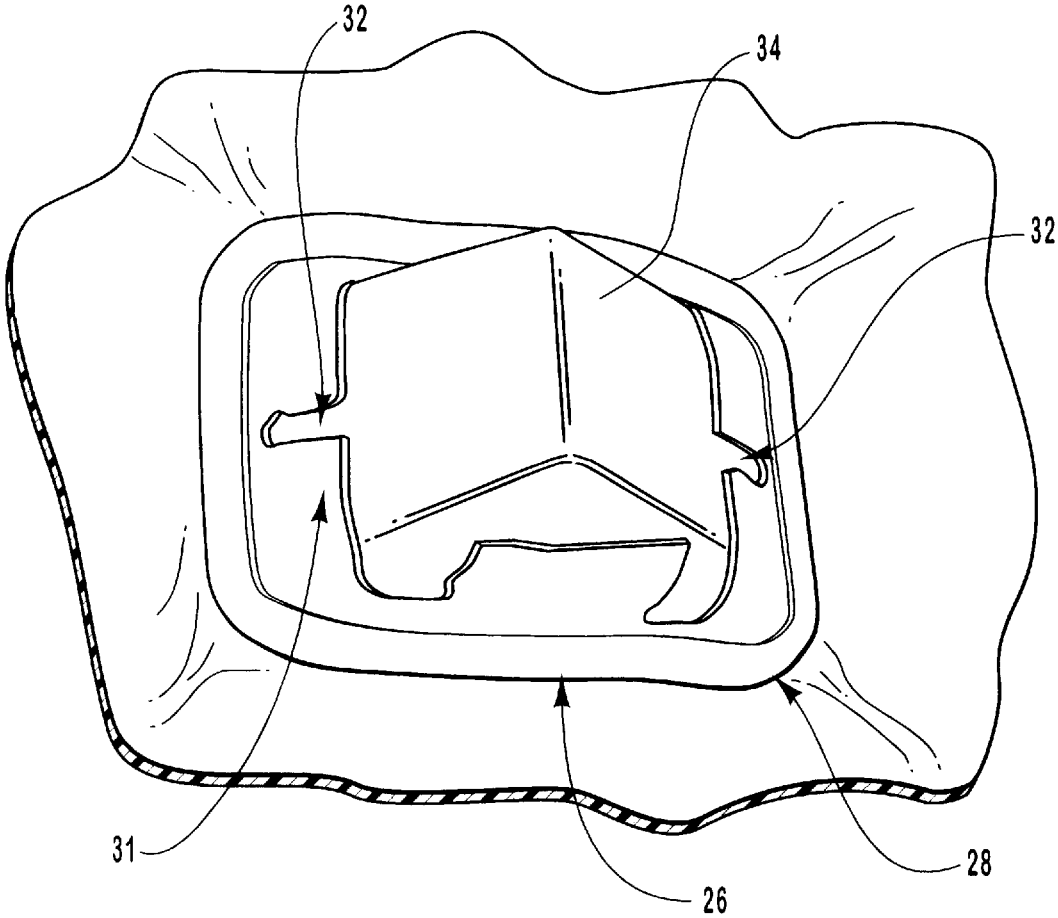
FIG. 3 is a perspective view of one embodiment of an aperture of the air packaging device of the present invention.

In the embodiment of FIG. 2, the interior 30 is configured with slots 32. The slots 32 act to separate the material as a corner of an object is inserted into the comer aperture 26. Referring to FIG. 3, a comer 34 of an object is shown as it is introduced into the corner aperture 26. The slots 32 allow the material 31 to yield and conform to the comer 34. The excess material 31 in the interior 30 acts to strengthen the perimeter 28 of the corner aperture 26 and absorb shocks to the device 16. The added strength of the excess material 31 is advantageous when shipping heavy objects which may otherwise tear out the perimeters 28 that define the corner apertures 26.

The slots 32 may be configured in various shapes and sizes including a "+" or cross shape. The slots 32 may also be configured such that a plurality of slots 32 are disposed perpendicular to another slot 32 as shown in FIG. 2. One of skill in the art will appreciate that the configuration and disposition of the slots 32 may vary and such variations are included within the scope of the invention.

In an alternative embodiment, the material of the interior 30 is retained intact. In such an embodiment, the material yields and conforms to an object that is introduced into the corner aperture 26.

The corner apertures 26 receive angular portions or corners of rectangular, triangular, and other angularly configured objects to suspend a device (i.e. a laptop computer) within a pocket of the device 16. The corner apertures 26 may be sized to the object to optimize the grip and retention capability. Thus, configuration of the corner apertures 26 may be based on weight, size, and dimension of the object being shipped. The device 16 may be configured with four corner apertures 26 for a rectangular object or three comer apertures 26 for a triangular object. In the embodiment of FIG. 2, the device 16 is disposed with two comer apertures 26 between each outer and inner panel 12, 14. The corner apertures 26 are spaced based on the size of the object to be shipped. With square shaped objects, the comer apertures 26 may be disposed substantially equidistant from one another.

Referring once again to FIG. 2, the device 16 is shown with a quilt 40. A quilt 40 is formed by sealing an outer panel 12 to an adjacent inner panel 14. One or more quilts 40 cause the packaging device 16 to conform to a desired shape when inflated. By appropriately placing the quilts 40, the inflated device 16 may approximate square, round, hexagonal, etc. shapes. In the embodiment of FIG. 2, the quilt 40 is formed between both pairs of outer and inner panels 12, 14. Thus, a mirror quilt 40 is formed between the opposing outer panel 12 and inner panel 14 not shown in FIG. 2.

The quilt 40 allows communication within the first or second chamber. Thus, the quilts 40 do not traverse the entire longitudinal length of the device 16 as they must allow for continued air flow within the chamber. Although the quilts 40 may define sub-chambers within a chamber, all sub-chambers remain in communication with one another. One of skill in the art will appreciate that the number and disposition of the quilts may vary and are included within the scope of the invention.

Figure 4:
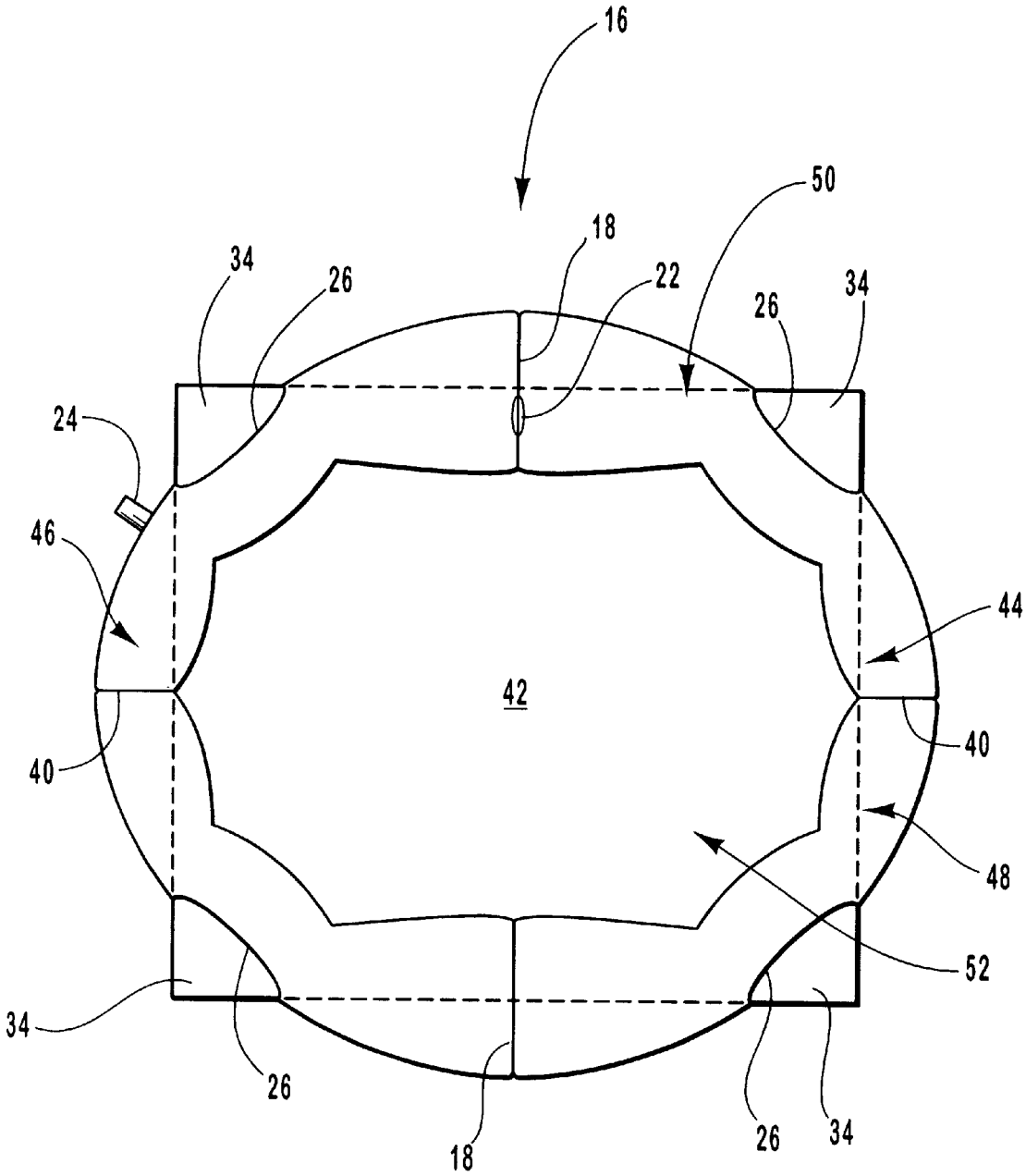
FIG. 4 is a plan view of one embodiment of the air packaging device.

Referring to FIG. 4, is a plan view of one embodiment of the inflated device 16 is shown with an object 42 (shown in dotted lines) contained therein. The inflated device 16 is configured to conform around the object 42. The quilts 40 and the peripheral edges 18 assist in conforming the inflated device 16 into the desired shape. As a filler medium 24 is introduced into the first and second chambers 44, 46, the chambers 44, 46 communicate with one another to provide equal pressure.

As discussed previously, the first and second chambers 44, 46 may be collectively referred to as a main chamber 48. The desired result is to provide a chamber 48 that traverses around a perimeter 50 of an object 42. The inner panels 14 of the device 16 define a pocket 52 with top and bottom openings. An object 42 is inserted into the device 16 with the comers 34 extending into the corner apertures 26 to retain and protect the object 42. The device 16 may therefore be described as a tubular inflatable device that circumscribes a perimeter 50 of an object 42.

Figure 5:
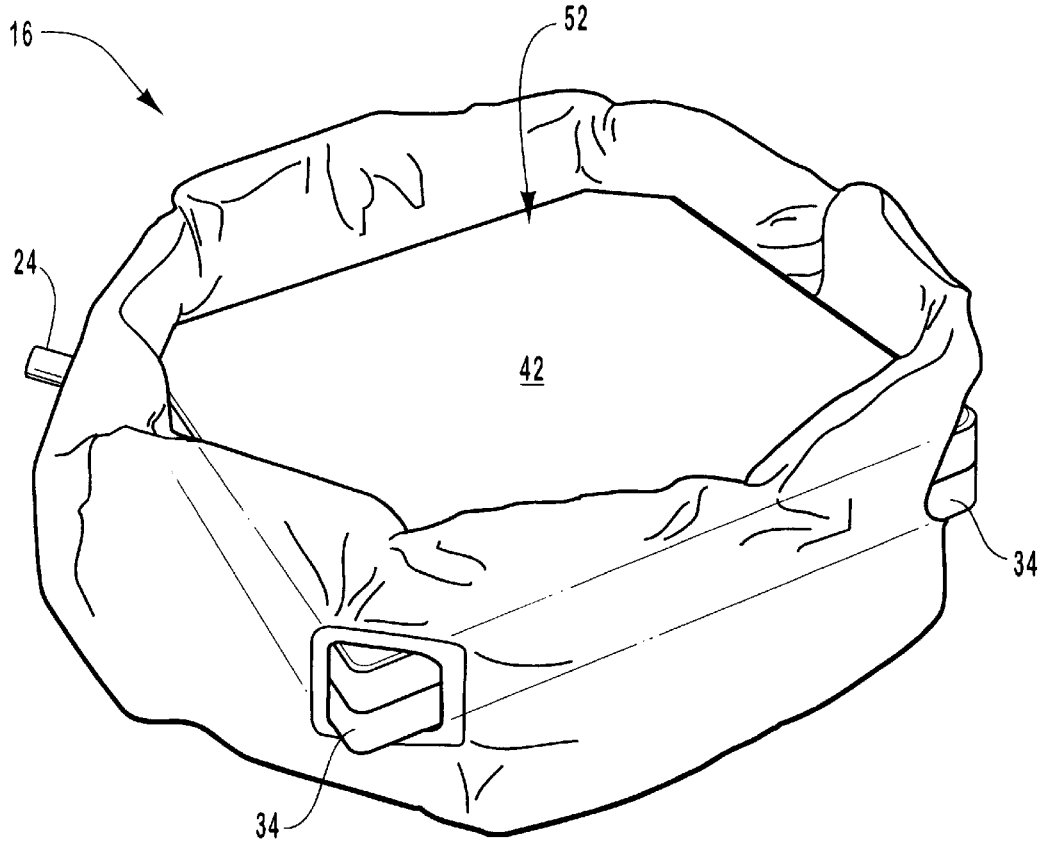
FIG. 5 is a perspective view of the embodiment of the air packaging device of FIG. 4.

Referring to FIG. 5, a perspective view of one embodiment of the inflated device 16 is shown. When the device 16 is inflated it may have approximately 1 to 2 inches of cushion barrier between the outside and inside of the device 16. In the embodiment shown, the comer apertures 26 are configured with the material completely removed from the interior 30.

Figure 6:
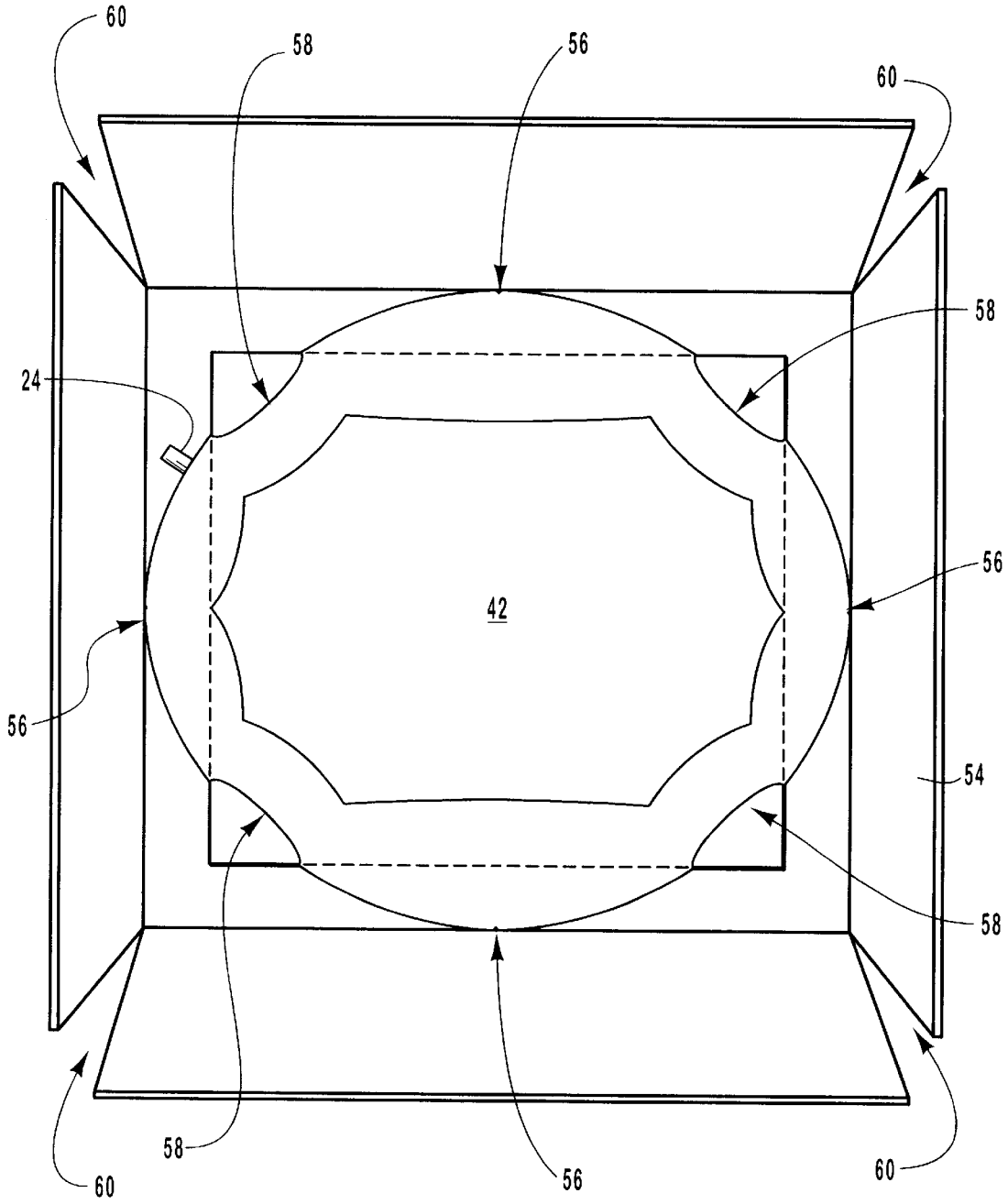
FIG. 6 is a plan view of the embodiment of the air packaging device of FIG. 5 disposed within an external container.

Referring to FIG. 6, the inflated packaging device 16 is shown with an object 42 contained therein and inserted into an exterior container 54. The exterior container 54 may be economically embodied as corrugated cardboard, but may also be embodied as wood, plastic, metal, etc. The exterior container 54 may be rectangular in configuration. Depending on the application, a plurality of devices 16 may be inserted into an exterior container 54. The main chamber 48 of the inflated packaging device 16 provides a cushion around the perimeter of the object 42 for compression against the exterior container 54 or other devices 16. The device 16 further provides a cushion around the object 42 for all axes.

The cushion generates an appropriate amount of force to resist compression for controlling the g-forces exerted on the object 42 when free-fall dropped. The force to compression length ratio may be selected to provide low g-force results during free-fall drop testing. The quilts 40 may assist in conforming the device 16 to increase contact with the exterior container 54. Greater contact with the exterior container 54 minimizes the gravitational forces applied to the packaging device 16.

Figure 7:
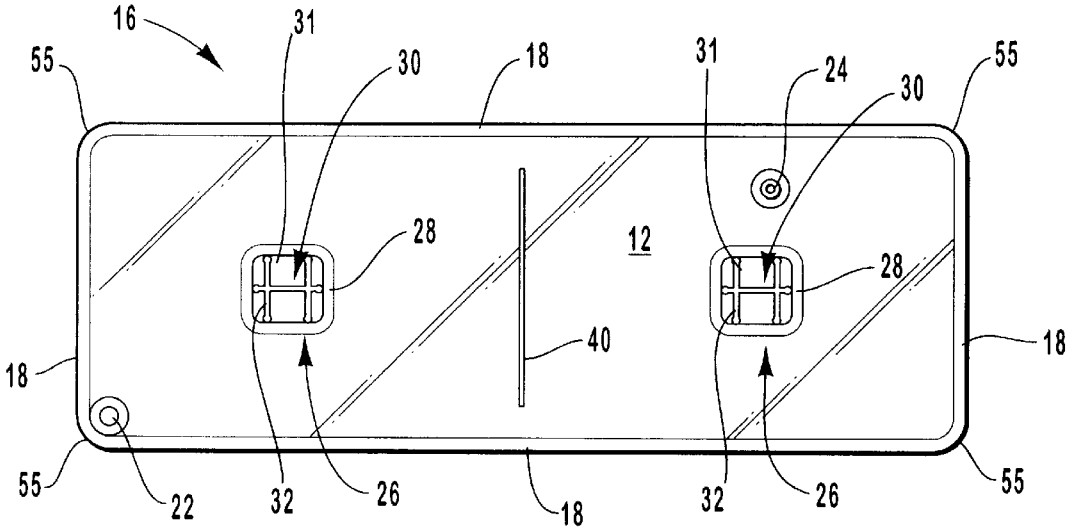
FIG. 7 is a plan view of an alternative embodiment of the air packaging device of the present invention.

Referring to FIG. 7, a plan view of an alternative embodiment of the device 16 is shown wherein the panels 10 are configured with rounded corners 55. As the packaging device 16 may be commonly inserted into an exterior container 54 the corners may be subjected to stress and wear. The rounded corners reduce the amount of stress and wear to provide a more resilient device 16.

The device 16 provides a circular air cushion chamber which is disposed around a perimeter of an object 42. When the device 16 is inflated, the object 42 is securely suspended within the pocket 52. The main chamber 48 of the device 16 works in harmony with the exterior container 54 to create a suspension ring. The outer surfaces of the device 16 are constrained by the exterior container 54 and push against the exterior container 54 on all sides or axes of the device 16.

Contact locations between the device 16 and the exterior container 54 are outer suspension points 56. As shown in FIG. 6, the device 16 contacts the exterior container 54 at six locations. This includes four contacts along the perimeter of the device 16 and bottom and top surface contacts. The corner apertures 26 engaging the corners 34 of an object 42 are inner suspension points 58. The embodiment of FIG. 6 includes four inner suspension points 58 based on the four corner apertures 26. The combination of inner and outer suspension points 58, 56 act in harmony to suspend and protect the object 42.

Forces applied to the exterior container 54 and the device 16 are distributed throughout the inner and outer suspension points 58, 56. The suspension points 58, 56 and the main chamber 48 create a distribution of force at the suspension points 58, 56 and dampen the g-forces. The force of a drop is distributed among the six outer suspension points 56 and the four inner suspension points 58. In conventional apparatuses, the suspension points do not act in harmony and do not equally distribute the force. Thus, the prior art devices are subject to more g-force loading in one direction than another. This advantage is more fully appreciated when objects are more sensitive to external force in one plane than another. With such objects, the present invention provides superior protection than that afforded by the prior art.

As shown in FIG. 6, when the device 16 is inserted into a properly sized container 54, the inner and outer suspension points 56, 58 are separated from the corners 60 of the exterior container 54. This is advantageous as corners 60 are frequently subject to the most abuse during shipping. The device 16 should therefore be used in conjunction with a properly sized exterior container 54 to support and position the device 16.

Figure 8:
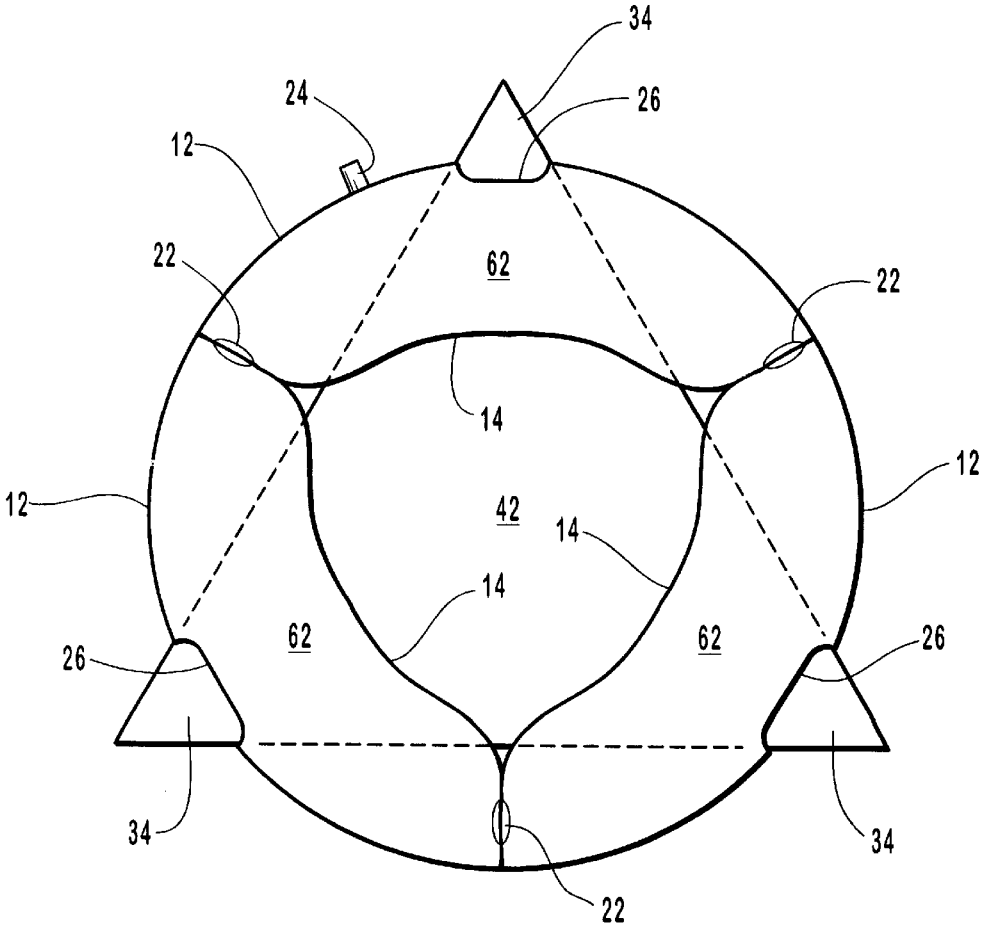
FIG. 8 is a plan view of an alternative embodiment of the air packaging device.

Referring to FIG. 8, a plan view of an alternative embodiment of the inflated device 16 is shown wherein the device 16 is configured to accommodate a triangular shaped object 42. As such, the device 16 is configured with three corner apertures 26 to accommodate the three corners 34. The device 16 may further be configured with three pairs of outer and inner panels 12, 14 that are sealed together to form three chambers 62. The three chambers 62 would be in communication with one another to form a main chamber 48 as in the previous embodiment to provide a cushion around the perimeter 50 of the object.

One of skill in the art will appreciate that the number of apertures 26 disposed on the device 16 may vary depending on the nature of the object 42 to be shipped. The device 16 may therefore have four apertures 26 to accommodate a rectangular object 42 and three apertures 26 to accommodate a triangular object 42. Thus, the device 16 may have two or more apertures 26 depending on the shape of the object 42 to be shipped.

Figure 9:
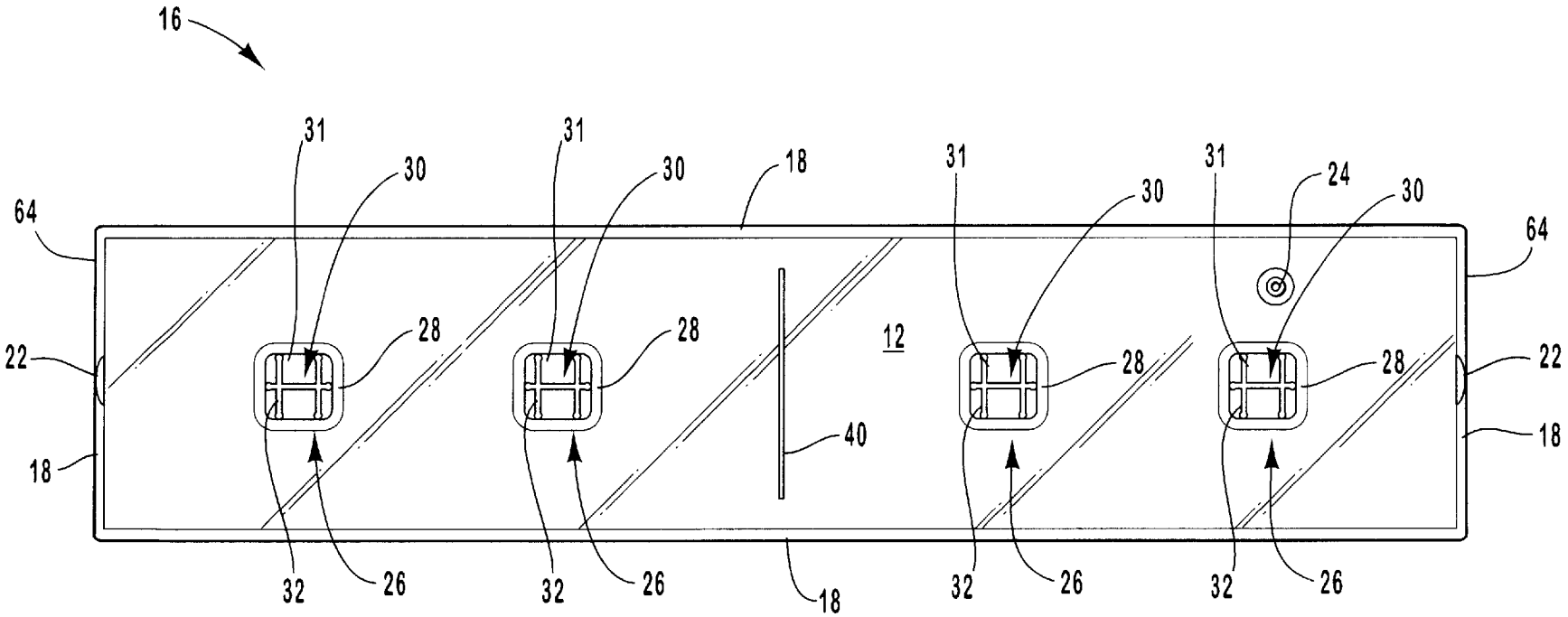
FIG. 9 is a plan view of an alternative embodiment of the air packaging device.

Referring to FIG. 9, a plan view of an alternative embodiment of the device 16 is shown. In this embodiment, the device 16 comprises a single outer panel 12 and a single inner panel 14 (not shown) which are sealed to one another along their upper and lower peripheral edges 18, 20. The ends 64 of the panels 12, 14 are further sealed to one another to form an inflatable main chamber 48 in a ring configuration.

An air exchange passage 22 may further be formed between the sealed ends 64 to allow communication between the ends 64. The device 16 further includes apertures 26 as previously described which are formed between the outer and inner panels 12, 14. The device 16 is further configured with a flow chamber 24 to provide inflation of the main chamber 48. The device 16 may further be configured with one or more quilts 40 as previously described.

One of skill in the art will appreciate that the number of inner and outer panels 14, 12 to form inner and outer surfaces of the suspension packaging device 16 may vary and are included within the scope of the invention. For example, in an alternative embodiment a single panel may be used that has peripheral ends sealed to itself to create a main chamber 48 with inner and outer surfaces. The inner and outer surfaces may then be sealed to one another to form comer apertures.

The invention is therefore not limited to an exact number of panels 10. It is sufficient to have inner and outer surfaces forming an inflatable main chamber 48. The inner and outer surfaces are further connected to one another to form corner apertures 26. The main chamber is then disposed entirely around a perimeter of an object 42 to provide a cushion barrier. An object 42 may then be inserted into a pocket 52 formed by the inner surface and suspended by the corners 34 engaging the apertures 26.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention.

What is claimed is:

1. An air packaging apparatus for receiving an object, comprising:

an outer surface having a gas impervious flexible material, and an inner surface having a gas impervious flexible material and secured to the outer surface to form an inflatable, tubular chamber encircling an object receiving pocket, the tubular chamber providing protection around the perimeter of the object, the outer surface and inner surface further secured to one another to form a plurality of apertures, each aperture configured to receive and engage a portion of the object to thereby retain and suspend the object within the pocket.

2. The apparatus of claim 1, wherein the outer and inner surface are further secured to one another to form a quilt.

3. The apparatus of claim 1, wherein the outer surface comprises two outer panels and the inner surface comprises two inner panels, the outer panels and the inner panels sealed to one another at their respective peripheral edges.

4. The apparatus of claim 1, further comprising a flow channel disposed on the outer surface and in communication with the chamber.

5. The apparatus of claim 1, further comprising material extending into the apertures, wherein the material is configured with slots to provide separation of the material as a portion of an object is introduced into the apertures.

6. The apparatus of claim 1, wherein the apertures include four apertures.

7. A method for manufacturing an air packaging device to retain an object, the method comprising:

forming an inner and an outer surface of gas impervious flexible material to define an inflatable, tubular chamber that encircles an object receiving pocket; and securing the inner surface and outer surface together to form a plurality of apertures, each aperture configured to receive and engage a portion of the object to thereby retain and suspend the object within the pocket.

8. The method of claim 7, further comprising inflating the chamber with a filler medium.

9. The method of claim 7, further comprising securing the outer and inner panels together to form a quilt.

10. The method of claim 7, wherein forming the inner surface and the outer surface comprises securing two outer panels and two inner panels to one another at their respective peripheral edges.

11. The method of claim 7, further comprising disposing a flow channel on the outer surface to communicate with the chamber.

12. The method of claim 7, further comprising extending material into the apertures, the material configured to conform as a portion of an object is introduced into the apertures.

13. The method of claim 7, wherein securing the inner surface and outer surface together to form a plurality of apertures further comprises forming four apertures.

14. A tubular, inflatable packaging apparatus configured to receive an object, comprising:

two overlying outer panels having a gas impervious flexible material;

two overlying inner panels having a gas impervious flexible material and disposed between the outer panels, the inner panels and outer panels secured to one another along their peripheral edges secured to form a tubular, inflatable chamber that encircles an object receiving pocket; and a plurality of apertures formed between the inner and outer panels and configured to receive and engage a portion of the object to thereby retain and suspend the object within the pocket.

15. The apparatus of claim 14, wherein the outer and inner panels are further secured to one another to form a quilt.

16. The apparatus of claim 14, further comprising a flow channel disposed on an outer panel and in communication with the chamber.

17. The apparatus of claim 14, further comprising material extending into the apertures, wherein the material is configured with slots to provide separation of the material as a portion of an object is introduced into the apertures.

18. The apparatus of claim 14, wherein the apertures include four apertures.

* * * * *